US009744737B2

(12) United States Patent
Habermann et al.

(10) Patent No.: US 9,744,737 B2
(45) Date of Patent: Aug. 29, 2017

(54) PRESS ROLLER

(71) Applicant: MASCHINENFABRIK KÖPPERN GMBH & CO. KG, Hattingen (DE)

(72) Inventors: Kai-Uwe Habermann, Muelheim (DE); Axel Hoefter, Meppen (DE); Andreas Thierfeld, Wetter (DE)

(73) Assignee: MASCHINENFABRIK KOEPPERN GMBH & CO. KG, Hattingen (DE)

( * ) Notice: Subject to any disclaimer, the term of this patent is extended or adjusted under 35 U.S.C. 154(b) by 0 days.

(21) Appl. No.: 14/767,726

(22) PCT Filed: Mar. 19, 2014

(86) PCT No.: PCT/EP2014/055478
§ 371 (c)(1),
(2) Date: Aug. 13, 2015

(87) PCT Pub. No.: WO2014/170080
PCT Pub. Date: Oct. 23, 2014

(65) Prior Publication Data

US 2016/0023418 A1 Jan. 28, 2016

(30) Foreign Application Priority Data

Apr. 17, 2013 (DE) ..... 10 2013 103 884

(51) Int. Cl.
*B30B 11/16* (2006.01)
*B02C 4/30* (2006.01)

(52) U.S. Cl.
CPC ..... *B30B 11/165* (2013.01); *B02C 4/30* (2013.01)

(58) Field of Classification Search
CPC ..... B30B 11/165; B30B 11/16; B30B 3/005; B02C 4/30; B02C 4/305
(Continued)

(56) References Cited

U.S. PATENT DOCUMENTS 661,617 A * 11/1900 McCanna ..... B02C 2/10 241/294
2,294,098 A * 8/1942 Stromer ..... B02C 4/30 241/294

(Continued)

FOREIGN PATENT DOCUMENTS

DE 4344206 A 6/1996
FR 1131552 B 2/1957

OTHER PUBLICATIONS

English translation of DE 4344206 A1.*

*Primary Examiner* — Jason L Vaughan
(74) *Attorney, Agent, or Firm* — Andrew Wilford

(57) ABSTRACT

The invention relates to a press roller for a roller press, in particular for briquetting, compacting or grinding granular material, having a roller core (1) and a roller sleeve fastened to the exterior of the roller core (1), said sleeve being composed of a plurality of segments (2), distributed over the circumference, with mutually facing lateral faces (3). The segments (2) have clamping shoulders (5) which extend around the front faces, the segments (2) being releasably fastened at each front face to the roller core (1) by means of at least one fastening ring (6). Said fastening ring fits over the clamping shoulders (5) of the segments (2). The fastening ring (6) is or can be clamped against the segments (2) by means of axially parallel clamping bolts (7). Each segment has at least one axially parallel opening for the clamping bolts which, relative to the extension in the circumferential direction, is arranged between the two lateral faces (3) of the segment (2).

8 Claims, 3 Drawing Sheets

(58) Field of Classification Search
USPC ..... 492/30, 31, 33, 34, 35, 36, 37; 493/38
See application file for complete search history.

(56) References Cited

U.S. PATENT DOCUMENTS 2,798,676 A * 7/1957 Heer ..... B02C 4/30 228/140
3,077,634 A * 2/1963 Komarek ..... B30B 11/165 100/155 R
3,090,105 A * 5/1963 Gibbar ..... B02C 4/305 241/294
3,873,259 A * 3/1975 Kennedy ..... B30B 15/34 425/237
3,907,486 A * 9/1975 Kennedy ..... B30B 15/34 425/237
3,938,930 A * 2/1976 Lauterbach ..... B30B 11/165 425/194
3,969,062 A 7/1976 Komarek
3,989,441 A * 11/1976 Lauterbach ..... B30B 11/165 29/724
4,034,461 A * 7/1977 Lauterbach ..... B30B 11/165 29/423
4,097,215 A * 6/1978 Komarek ..... B30B 11/165 425/237
4,123,971 A 11/1978 Bergendahl
4,337,023 A * 6/1982 Koppern ..... B30B 11/165 425/237
5,000,392 A * 3/1991 Kästingschäfer ..... B02C 4/305 241/294
5,253,816 A * 10/1993 Kastingschafer ..... B02C 4/30 100/176
5,755,033 A * 5/1998 Gunter ..... B02C 4/305 29/895.3
2014/0158801 A1 * 6/2014 Euculano ..... B02C 4/305 241/294

* cited by examiner

PRESS ROLLER

CROSS REFERENCE TO RELATED APPLICATIONS

This application is the US-national stage of PCT application PCT/EP2014/055478 filed 19 Mar. 2014 and claiming the priority of German patent application 102013103884.0 itself filed 17 Apr. 2013.

FIELD OF THE INVENTION

The invention relates to a press roller for a roller press, particularly for briquetting, compacting or grinding granular material.

BACKGROUND OF THE INVENTION

Such a press roller normally has a roller core and a roller sleeve secured to the outer surface of the roller core and formed by a plurality of segments distributed over the outer surface with confronting side faces, the segments having clamping shoulders on their end faces with first clamping faces and the segments being secured detachably on the end face with at least one respective fastening ring to the roller core that engages over the clamping shoulders of the segments. It is preferably a press roller for a roller press for hot-briquetting or hot-compacting, for example hot-briquetting or hot-compacting of directly reduced iron (DRI). According to the invention, granular material also refers to dust or powder. The (bilateral) side faces are surfaces that delimit the respective segment in the circumferential direction. The side faces of a segment consequently angularly confront side faces of segments that are angularly adjacent and that extend axially, and they are clamped axially and radially and delimited by the inner surface and the outer surface of the segment.

A roller press generally has counterrotating two press rollers. During briquetting or compacting, granular bulk material is compacted between the rollers. To this end, the roller sleeve formed by the segments is equipped with pressing tools that can have cavities for the briquetting or compacting. However, the invention also includes press rollers with segments that are provided with another wear protection layer, for example for the comminuting material. Particularly during hot briquetting or hot compacting, the press rollers are exposed to high temperatures from the material to be processed, so that the segments themselves also reach high temperatures. This applies, for example, to the processing of reduced iron ores or sponge iron, in which the temperatures can reach up to 900° C. At high temperatures, the segments and their pressing tools are generally subjected to wear. In order to limit wear, such press rollers and their casings are generally cooled, for example by water. It has long since been known to integrate cooling passages into the clamping rings of the rollers.

Since the (tool) segments are generally subject to wear, they are detachably and thus exchangeably secured to the roller core. The fastening is done with by bilateral fastening rings that are also referred to as locking or clamping rings and that engage over the bilateral clamping shoulders of the segments. High demands are placed on the stability of these segments in practice, since they are subjected to high loads.

A roller press for hot compacting and hot briquetting bulk materials with press rollers with segments is known, for example, from DE 25 36 670 [U.S. Pat. No. 4,123,971]. The segments are provided with lugs or shoulders on which fasteners engage that secure the segments to the roller core. In this prior-art design, clamping brackets supported on the roller core are provided as fasteners that are pressed against the segment by a tension bolt. Alternatively, cooled shrink rings, radially arranged screws or the like are also proposed as fasteners.

The fastening of the segments by fastening rings or clamping rings that engage over the clamping shoulders of the segments is also known in practice. The clamping shoulders generally have the same cross section over the entire angular extent of the segment. The clamping bolts are provided at the region of the side faces between two mutually adjacent segments. To this end, suitable grooves are worked into the side faces to receive the clamping bolts. The known designs have proven themselves in principle, but they can be further developed with respect to their stability and durability. This is where the invention comes in.

OBJECT OF THE INVENTION

It is the object of the invention to provide a press roller for a roller press of the type mentioned above that is characterized by the high level of stability and durability of the segments while being of simple construction and easy to assemble, so that long service lives for the segments are ensured.

SUMMARY OF THE INVENTION

To achieve this object, the invention teaches, with a generic press roller for a roller press of the type mentioned above, that the segments each have at least one axially extending throughgoing hole for a respective one of the clamping bolts that are between the two side faces of the segment).

The invention proceeds from the insight that the stability and thus the service life of the segments can be increased if the clamping bolts with which the two fastening rings are braced against each other under interposition of the segments are not arranged near the side faces and consequently not between two mutually adjacent or successive segments, but rather if a throughgoing hole for the clamping bolt is integrated into the segment, for example centered between the two side faces, particularly angularly. The result of these measures is that no axially extending grooves, projections or the like need to be formed in the side faces of the segments that receive a clamping bolt between two segments in the assembled state. By virtue of the measures according to the invention, possible weak points of the segments, particularly near the side faces, are avoided, thus increasing the stability of the segment. The formation of the axially extending throughgoing holes, for example as a bore, is done using simple technical means without impairing the stability of the segment. Likewise, a simple bracing is possible in this way.

Additional aspects of the invention are explained in the following:

The clamping shoulders have, in a basically known manner, first clamping faces, and the clamping ring has, also in a known manner, second clamping faces; that is, the clamping faces of the clamping ring press onto the clamping faces of the clamping shoulders during assembly so that the segments are braced on the roller core. For this purpose, it is expedient if the first clamping faces and/or the second clamping faces are aligned at an acute angle to the roller axis in order to generate radial clamping force when tightening the axially extending clamping bolts. The clamping forces applied axially are thus intensified in the radial direction, thus ensuring the trouble-free fixation of the segments on the roller core. In addition to this non-positive connection, however, provision is made that the segments are also held in a positive manner on the roller core. For this purpose, the segments can have on their inner surfaces and the roller core has on its outer surface suitable positive-fitting elements (projections and recesses), thus implementing, for example, a tongue-and-groove connection between segments and roller core.

The fastening ring preferably has a clamping collar engaging over the clamping shoulder of the segments, this clamping collar having the second clamping faces that bear on the first clamping faces of the clamping shoulders of the segments. In a preferred embodiment, the clamping ring can thus consist of a completely annular base ring and a clamping ring formed thereon and preferably also completely annular, so that the clamping ring or fastening ring itself (substantially) of L-section.

It lies within the scope of the invention for the clamping ring or its clamping collar with a full angular-length (second) clamping face to be braced against the likewise full angular-length (first) clamping face of the segments.

Especially preferably, however, a fastening ring is used having locally angularly limited clamping projections that are spaced angularly so that at least one locally limited clamping projection is associated with each individual segment. As a result, the clamping ring can (for example near the clamping collar, for example) have clamping projections distributed over the outer surface, each associated with a segment and having the second clamping faces, that for example each extend over only a portion of the angular extent of a segment. With such an embodiment of the clamping ring with clamping projections, it is especially expedient if the segments have (outer) material reinforcements on their end faces in the end-face edge regions near the side faces that project radially outward from the first clamping face and form pocket-like recesses angularly therebetween with the first clamping faces against which the second clamping face of the fastening ring rest. The invention operates from the insight that the fastening ring need not be braced over the entire outer surface with the segments, but rather that a locally limited bracing with the aid of the described clamping projections, for example, is sufficient. In this case, it is then possible to provide the segments with additional material reinforcements and thus thickened region, since no clamping faces need to be made available in these regions for bracing. In this way, the stability of the segments can be improved substantially in the especially critical regions, thus further increasing the service life. The clamping ring thus acts only in a central region on the segments, the clamping bolts also being in this central region. As a result, the clamping ring is formed as a crown with crown-like projections that project preferably inward from the clamping collar in the radial direction (i.e. radially inward) and also project axially inward from the clamping ring or its base ring (i.e., toward the segment). Preferably, a projection of the clamping ring is associated with each segment or each pocket. Several projections can also engage in one pocket, however.

The throughgoing holes essential to the invention described above for the clamping bolts are preferably between the described material reinforcements near the pocket-like recesses.

Another proposal of the invention relates to the shape of the side faces of the segment. It was already explained that grooves or the like near the side faces for guiding the clamping bolts can be omitted. Nevertheless, a certain shaping of the side faces can be expedient. For instance, one side face of the segment has a projection (nose) for example, and the other side face of the segment has a corresponding recess (pocket), the projection of one segment engaging in a manner similar to a tongue-in-groove connection into a corresponding pocket of the adjacent or following segment. In this way, the footprints of the segments are enlarged, and forces not passing through the center of the roller can be better withstood.

This embodiment, which is similar to a tongue-and-groove connection, relates substantially to the central region of the side face. The side faces are consequently planar in the side face edge regions associated with the front sides, that is to both sides of the nose/pocket over the entire radial thickness of the segment and radially outward of the noses/pockets over the entire axial thickness of the segment and are consequently stepless. Through such a substantially level/stepless embodiment of the edge regions of the side faces, weak points are avoided, thus achieving an especially stable construction.

The object of the invention is also a roller press with two press rollers of the described type. The press rollers essential to the invention are therefore protected especially preferably in combination within a roller press. Such a roller press can preferably be designed for briquetting and/or compacting granular material, particularly for hot-briquetting/hot-compacting.

BRIEF DESCRIPTION OF THE DRAWING

The invention is described in further detail below with reference a figure illustrating only one embodiment.

SPECIFIC DESCRIPTION OF THE INVENTION

Figure 1:
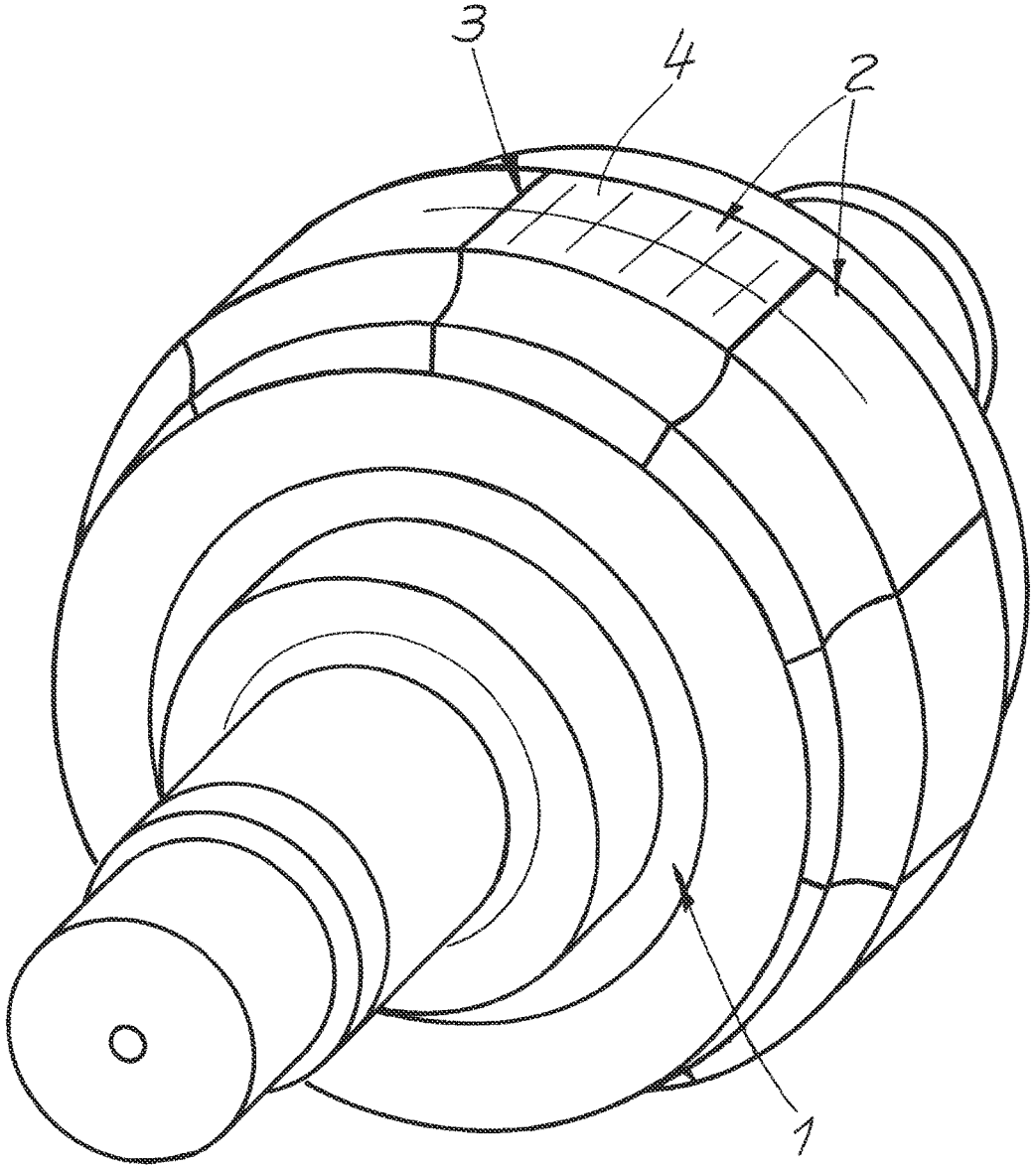
FIG. 1 is a schematic simplified perspective view of a press roller.

FIG. 1 shows a press roller for a roller press, particularly for briquetting or compacting and especially preferably for hot briquetting or hot compacting granular material. Basically, such a press roller consists of a roller core 1 and a roller sleeve secured to the roller core 1 that is formed by a plurality of segments 2 distributed over the outer surface, these segments 2 having axially extending side faces 3. The segments 2 each have a profiled outer surface; here, they have cavities 4 for briquetting or compacting. These shaping tools/cavities 4 are unitarily formed in each segment 2. Each segment 2 has a clamping shoulder 5 on each axial end.

Figure 2:
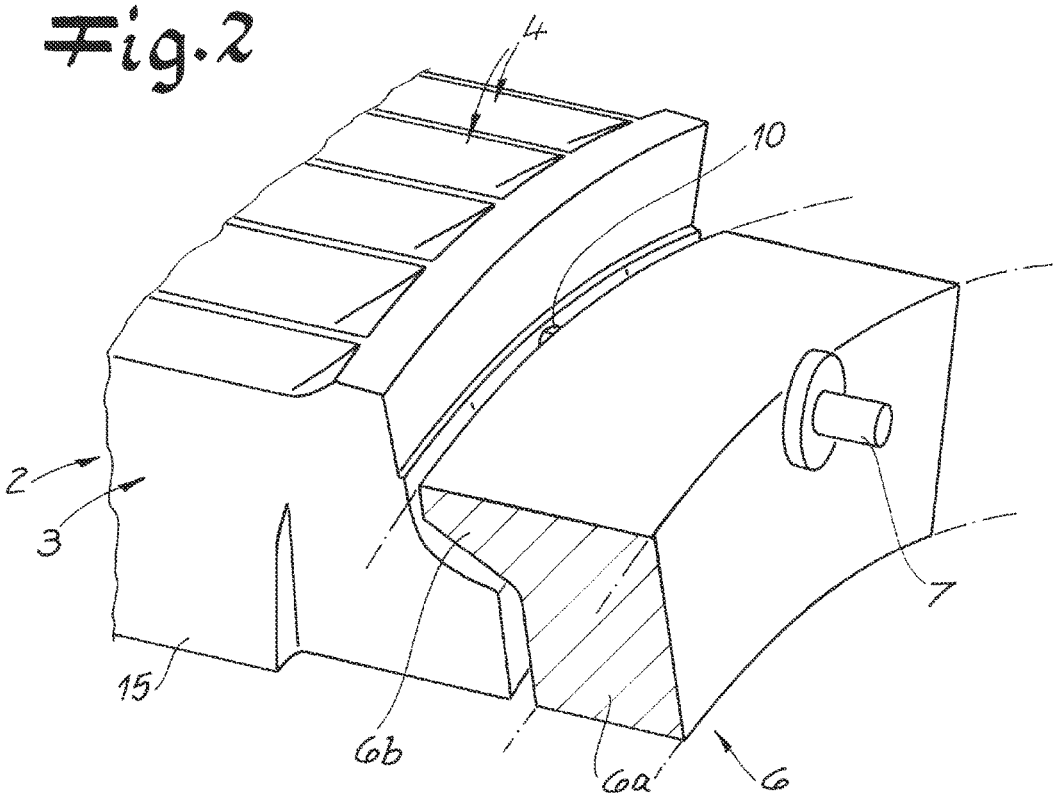
FIG. 2 is a perspective section of the roller according to FIG. 1.
Figure 3:
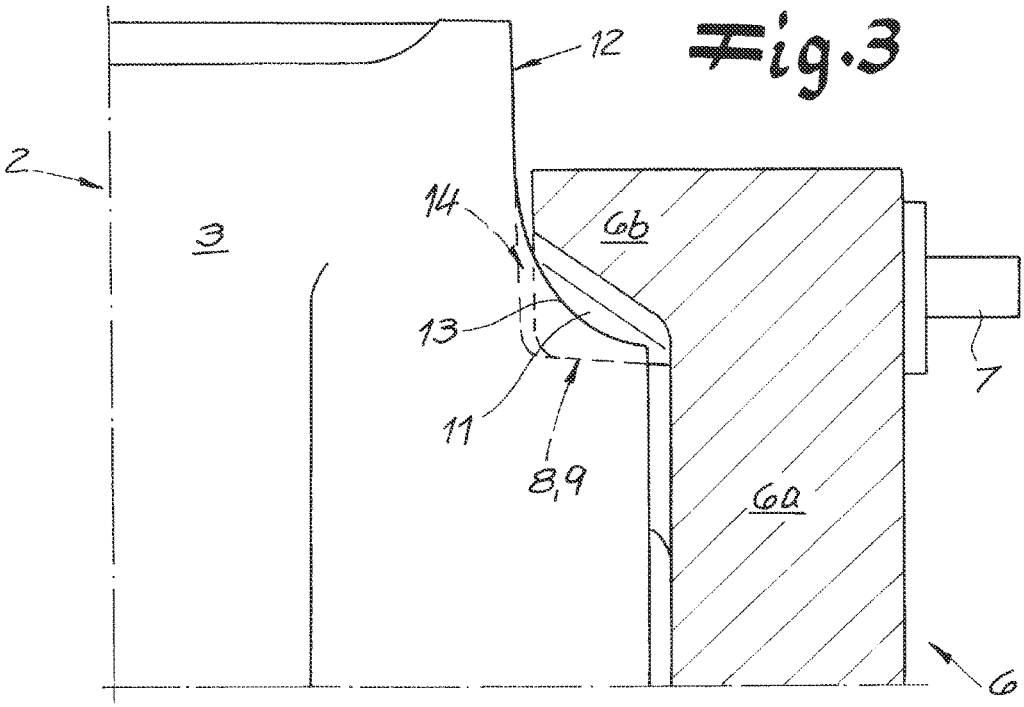
FIG. 3 is a side view of the roller as in FIG. 2.
Figure 4:
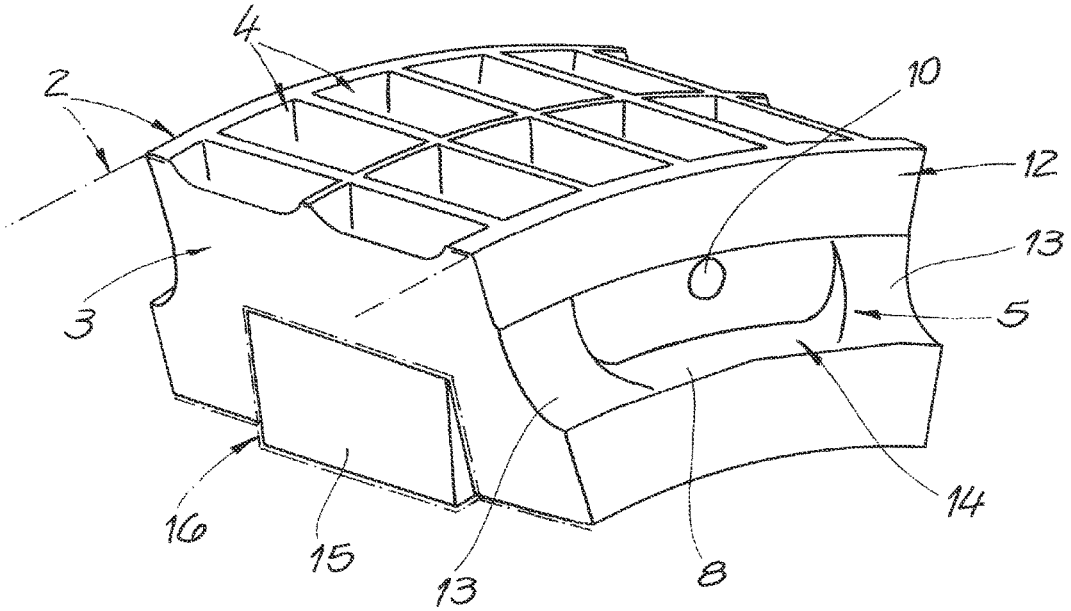
FIG. 4 is a perspective view of the press roller according to FIG. 1.
Figure 5:
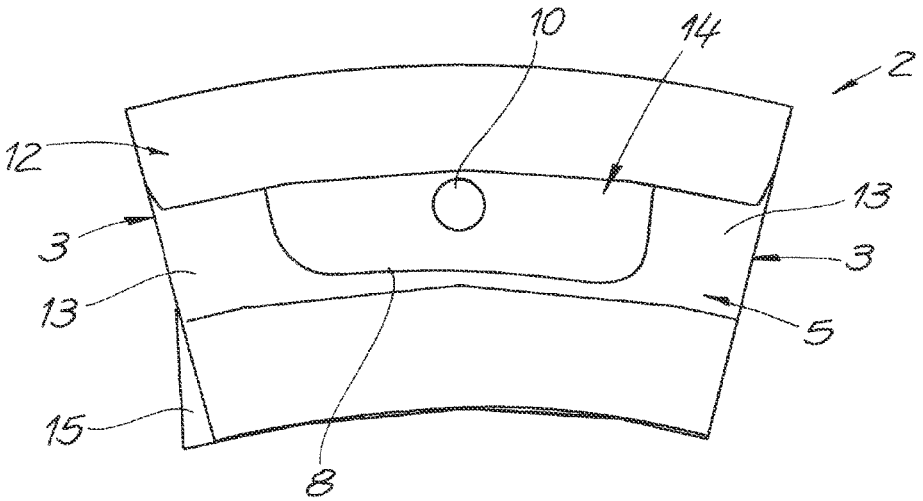
FIG. 5 is a front view of the roller as in FIG. 4.

The fastening of the segments 2 on the roller core 1 is done with two fastening rings 6 that are also referred to as clamping collars or clamping rings. They are shown in FIG. 2. The two fastening rings 6 are placed at the ends, so that they engage over the clamping shoulders 5 of the segments 2. The two fastening rings 6 are secured by axially extending clamping bolts 7 against the ends of the segments 2 they axially flank. The clamping shoulders 5 have first clamping faces 8, and the clamping ring 6 has second clamping faces 9. In order to enable the generation of radial force when the axially extending clamping bolts 7 are tightened, the first clamping face 8 and the second clamping face 9 extend at an acute angle to the roller axis. The axial or axially extending clamping force applied by the clamping bolts 7 is consequently amplified and converted into a radially inward clamping force, thus ensuring solid fastening of the segments 2 on the roller core 1. A positive connection can also be provided between the segments 2 and the roller core 1, for example by having positively interfitting formations of the segments 2 on the inner surface (or lower side) engage in complementary formations of the roller core 1 on the outer surface (and/or vice versa). In any case, special importance is given in the illustrated embodiment to clamping the segments 2 by the fastening ring 6 and the clamping bolts 7. Each fastening ring 6 is profiled in cross section. It has an angularly extending base 6*a* on the one hand and an angularly extending clamping collar 6*b* on the other hand, so that it is of substantially L-section. This circumferential clamping collar 6*b* engages with the second clamping faces 9 over the clamping shoulders 5 of the segments 2, so that the second clamping faces 9 of the clamping ring 6 are pressed radially inward against the first clamping faces 8 of the clamping shoulders 5.

The segments 2 each have an axially extending and throughgoing hole 10 through which the clamping bolts 7 extend. These axially throughgoing holes 10 are each angularly between the two side faces 3 of a segment 2. In this embodiment, the hole 10 of a segment 2 is angularly centered between the two side faces 3 of the respective segment. The throughgoing holes 10 are bores, and they extend through the entire axial length of the respective segments 2, so they engage completely through the segments. In this way, the two fastening rings 6 can be braced on both sides of the segments with each other under interposition of the segments 2.

Here, the clamping ring 6 does not have a uniform cross section over all of its circumference, but rather the clamping ring 6 has locally limited clamping projections 11. The clamping ring 6 thus has a plurality of clamping projections 11, each associated with a segment 2, distributed over the outer surface, each of these clamping projections 11 forms a respective one of the second clamping faces 9. The clamping projections 11 thus extend over only a portion of the angular length of a segment 2, so that the force input from the clamping ring 6 does not occur over the full outer surface or over the entire surface, but only in a locally limited manner near the clamping projections 11.

The segments 2 have outer material reinforcements 13 on their end faces 12 and their clamping shoulders 5 (or in the transition region between end face 12 and clamping shoulder 5). These material reinforcements 13 project outward relative to the first clamping face 8 radially and axially relative to the end face 12, so that a respective pocket 14 is provided angularly between two material reinforcements 13 of a segment 2. The first clamping faces 8 of the segments 2 fit in these pockets 14, i.e. the clamping ring 6 engages with its locally limited clamping projections 11 into these pockets 14 of the segments. The material reinforcements 13 that are on the end faces of the segments 2 at the side faces thus do not impair trouble free bracing. They provide increased stability in regions of the segments that are subjected to especially high loads. The clamping ring 6 is thus formed as a sort of crown. The second clamping faces 9 are each on a radial inner side of a respective one of the locally limited clamping projections 11, this second clamping face 9 as well as the first clamping face 8 of the segments 2 can extend in the pockets 14 at an acute angle to the roller axis.

Moreover, the drawing shows that two segments angularly one after the other engage in each other. To this end, one side face 3 of a segment 2 has an angularly projecting nose 15 while the opposite side face 3 of the same segment 2 has a complementary angularly open pocket 16 so that the nose 16 of a segment engages in a manner similar to a tongue and groove connection into the complementary pocket 16 of the angularly adjacent segment. Apart from these elements (noses 15/pockets 16), the side faces 3 are flat or planar and thus stepless. In particular, profiling for the clamping bolts or clamping rods 7 can be omitted, since these clamping bolts are guided according to the invention through the central holes in the segment 2. In this way, the side faces 3, particularly near the end faces, namely on both sides of the noses and pockets over the entire radial thickness of the segment and radially above the noses/pockets, can be planar and thus stepless over the entire axial thickness of the segment. Notches and projections are thus avoided, which contributes to an increase in the strength and durability of the individual segments.

The invention claimed is:

1. A press roller for a roller press for briquetting, compacting or grinding granular material, the roller comprising:

a roller core defining and centered on an axis;

a roller sleeve secured on an outer surface of the roller core, having axial ends, and formed by a plurality of angularly distributed segments with mutually angularly confronting side faces, the segments each formed with a clamping shoulder, an axially extending throughgoing hole between and offset from the respective side faces, and an axially open pocket spaced between the respective side faces and forming a generally radially outwardly directed first clamping face extending at an acute angle to the roller axis;

respective completely annular fastening rings detachably securing the segments at each axial end to the roller core and engaging over the clamping shoulders of the segments, the rings each having an annular array of respective angularly spaced axial projections each at a respective one of the segments, each fittable in the pocket of the respective segment, and each having a generally radially inwardly directed second clamping face engageable with a respective one of the first clamping faces; and respective clamping bolts axially bracing the fastening rings against the segments and each extending axially through a respective one of holes such that tightening of the bolts presses the second clamping faces against the first clamping faces and presses the respective rings axially and radially inwardly against the segments.

2. The press roller defined in claim 1, wherein the fastening ring has a clamping collar engaging over the clamping shoulder of the segments with the second clamping faces that is braced with the clamping bolts against complementary first clamping faces of the clamping shoulders of the segments.

3. The press roller defined in claim 1, wherein the segments have outer material reinforcements on their end faces or clamping shoulders in end-face edge regions near the side faces that project radially outward from the first clamping face or axially outward from the end face and form pockets with the first clamping faces angularly therebetween against which the second clamping faces of the fastening ring bear.

4. The press roller defined in claim 1, wherein the throughgoing hole of each segment is angularly centered between the respective side faces.

5. The press roller defined in claim 1, wherein the fastening rings on the opposite end faces of the roller are both braced against each other by the axial clamping bolts that engage completely through the segments.

6. The press roller defined in claim 1, wherein one side face of each segment has a projection and the other side face of each segment has a complementary recess, the projection of one segment engaging in the complementary recess of the following segment.

7. The press roller defined in claim 6, wherein the side faces are flat and stepless over the entire radial thickness of the segment in the side face edge regions near front sides to both sides of the projection or of the recess.

8. The press roller defined in claim 1, wherein the segments have first clamping faces extending over their entire angular length and/or the clamping ring has a second clamping face along its entire angular length.

* * * * *